US011742628B2

(12) United States Patent
Wu et al.

(10) Patent No.: US 11,742,628 B2
(45) Date of Patent: Aug. 29, 2023

(54) CONNECTOR TERMINAL AND MANUFACTURING METHOD THEREOF

(71) Applicant: DONGGUAN LUXSHARE TECHNOLOGIES CO., LTD, Dongguan (CN)

(72) Inventors: Xiaoping Wu, Dongguan (CN); Rongzhe Guo, Dongguan (CN); Xiaogang Liu, Dongguan (CN); Bin Huang, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 89 days.

(21) Appl. No.: 17/459,024

(22) Filed: Aug. 27, 2021

(65) Prior Publication Data

US 2022/0385017 A1 Dec. 1, 2022

(30) Foreign Application Priority Data

May 31, 2021 (CN) ..... 202110600727.3

(51) Int. Cl.

| | |
|---|---|
| ***H01R 43/24*** | (2006.01) |
| ***H01R 12/57*** | (2011.01) |
| ***H01R 13/405*** | (2006.01) |
| ***H01R 43/16*** | (2006.01) |

(52) U.S. Cl.

CPC ..... *H01R 43/24* (2013.01); *H01R 12/57* (2013.01); *H01R 13/405* (2013.01); *H01R 43/16* (2013.01)

(58) Field of Classification Search

CPC ..... H01R 12/716; H01R 24/50; H01R 12/724

See application file for complete search history.

(56) References Cited

U.S. PATENT DOCUMENTS

| | | | | |
|---|---|---|---|---|
| 8,142,207 | B1 * | 3/2012 | Ljubijankic | H01R 13/6473 439/95 |
| 8,480,436 | B2 * | 7/2013 | Chang | H01R 12/724 439/660 |
| 9,455,530 | B2 * | 9/2016 | Patel | H01R 13/6597 |
| 10,135,197 | B2 * | 11/2018 | Little | H01R 12/58 |

(Continued)

FOREIGN PATENT DOCUMENTS

| | | |
|---|---|---|
| CN | 209487769 U | 10/2019 |
| CN | 111029857 A | 4/2020 |

(Continued)

*Primary Examiner* — Truc T Nguyen

(74) *Attorney, Agent, or Firm* — Birch, Stewart, Kolasch & Birch, LLP

(57) ABSTRACT

The connector terminal includes an insulation body and multiple terminal bodies. Each of the multiple terminal bodies includes: a base part, an elastic arm and a welding part. The base part includes a first base part and a second base part, the first base part and the second base part form a bending structure, a first end of the first base part is embedded in the insulation body, a second end of the first base part is connected to a first end of the second base part, and a second end of the second base part is embedded in the insulation body. The elastic arm is connected to the first end of the first base part and extends out of a first end of the insulation body. The welding part is connected to the second end of the second base part and extends out of a second end of the insulation body.

15 Claims, 3 Drawing Sheets

(56) References Cited

U.S. PATENT DOCUMENTS

| | | | | |
|---|---|---|---|---|
| 10,644,455 | B1 * | 5/2020 | Champion | H01R 13/6464 |
| 11,527,844 | B2 * | 12/2022 | Chung | H01R 13/6474 |
| 2010/0167594 | A1 * | 7/2010 | Lee | H01R 13/62<br>439/660 |
| 2012/0015561 | A1 * | 1/2012 | Tsai | H01R 24/60<br>439/660 |
| 2012/0252273 | A1 * | 10/2012 | Chang | H01R 12/724<br>439/620.15 |
| 2017/0302037 | A1 * | 10/2017 | Yao | H01R 24/60 |
| 2019/0207327 | A1 * | 7/2019 | Huang | H01R 12/7082 |
| 2020/0076131 | A1 * | 3/2020 | Hu | H01R 13/6597 |

FOREIGN PATENT DOCUMENTS

| | | | |
|---|---|---|---|
| CN | 111370945 | A | 7/2020 |
| CN | 211480341 | U | 9/2020 |
| CN | 212966438 | U | 4/2021 |
| TW | M512237 | U | 11/2015 |

* cited by examiner

CONNECTOR TERMINAL AND MANUFACTURING METHOD THEREOF

CROSS-REFERENCE TO RELATED APPLICATION(S)

This application claims priority to Chinese Patent Application No. 202110600727.3 filed May 31, 2021, the disclosure of which is incorporated herein by reference in its entirety.

TECHNICAL FIELD

The present disclosure relates to the technical field of connectors and, in particular, to a connector terminal and a manufacturing method thereof.

BACKGROUND

In the related art, connector terminals are generally formed by connecting multiple sections of bending structures. In the related art, a connector terminal processing method, because the structure shape of the connector terminal is complex and changeable, it is often necessary to carry out a bending and pressing process first, then carry out the injection molding, and carry out a secondary bending and pressing process after the injection molding. However, in this processing method, the secondary bending and pressing not only causes the process to be complexed, but also affects the processing accuracy, increasing the manufacturing costs.

SUMMARY

The present disclosure provides a connector terminal and a manufacturing method thereof, which simplifies the processing technology, facilitates improving the processing accuracy and reducing the manufacture costs.

The technical solution described below is provided.

A connector terminal includes: an insulation body and multiple terminal bodies arranged on the insulation body. Each of the multiple terminal bodies includes a base part, an elastic arm and a welding part.

The base part includes a first base part and a second base part which are arranged at an included angle, the first base part and the second base part form a bending structure, a first end of the first base part is embedded in the insulation body, a second end of the first base part is connected to a first end of the second base part, and a second end of the second base part is embedded in the insulation body.

The elastic arm is connected to the first end of the first base part and extends out of a first end of the insulation body.

The welding part is connected to the second end of the second base part and extends out of a second end of the insulation body.

A manufacturing method of a connector terminal is provided. The connector terminal includes: an insulation body and multiple terminal bodies embedded in the insulation body described above. The method includes: a cutting and bending step and an injection molding step.

In the cutting and bending step, the multiple terminal bodies are pressure molded so as to be cut and bent for one time.

In the injection molding step, the insulation body is injection molded on the multiple terminal bodies.

BRIEF DESCRIPTION OF DRAWINGS

The accompanying drawings used in description of the embodiments will be described below. Apparently, the accompanying drawings described below illustrate part of embodiments of the present disclosure, and those skilled in the art may obtain other drawings on the basis of the contents and the accompanying drawings described below on the premise that no creative work is done.

REFERENCE LIST

Figure 1:
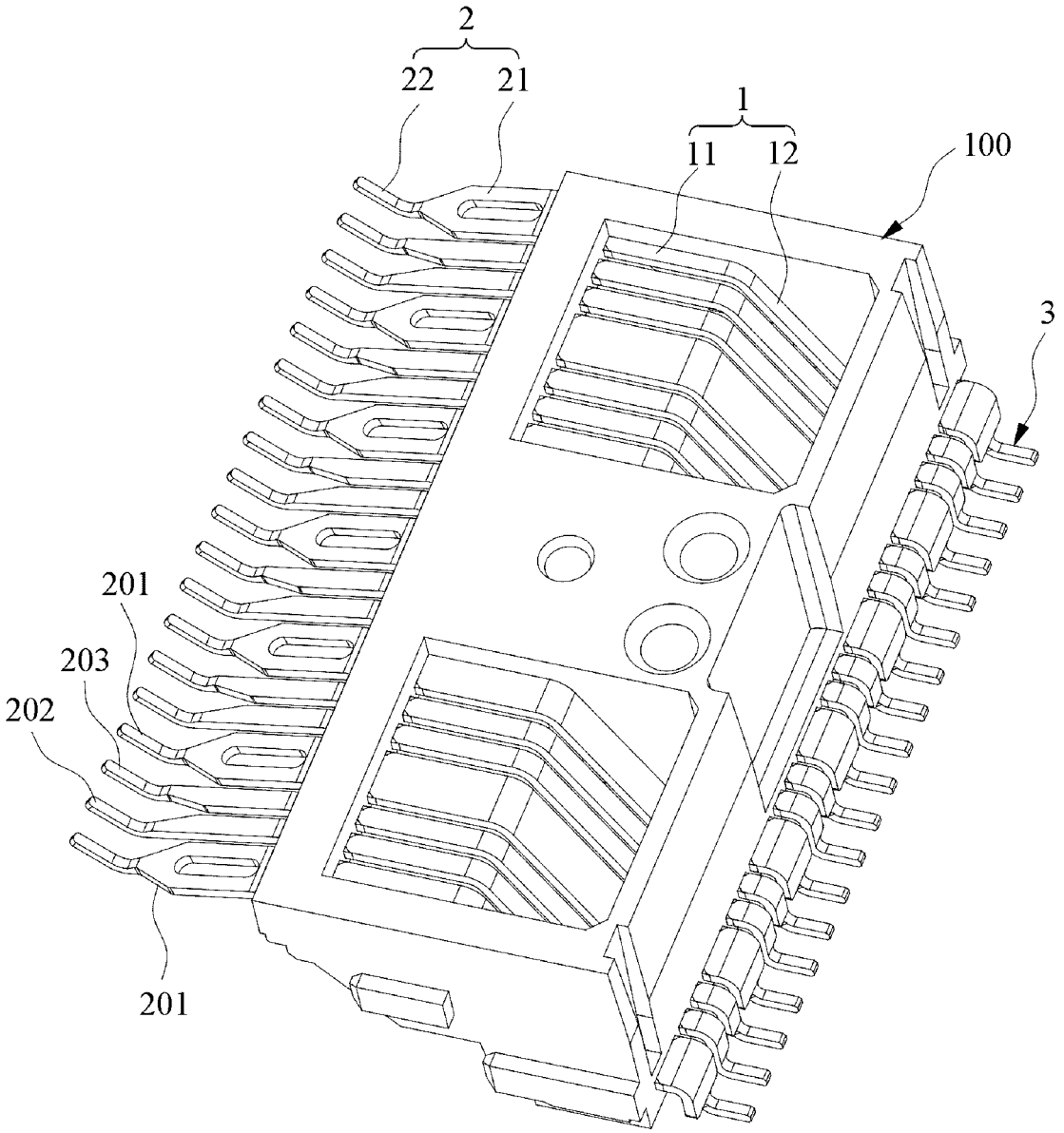
FIG. 1 is a structural diagram of a connector terminal provided by an embodiment of the present disclosure.

100—insulation body;

201—first terminal body; 202—second terminal body; 203—third terminal body;

1—base part; 11—first base part; 111—second fixing part; 12—second base part; 121—first fixing part; 13—second arc-shaped section;

2—elastic arm; 21—support part; 211—extension section; 2111—third side; 2112—fourth side; 212—first side; 213—second side; 22—contact part; 221—first arc-shaped section;

3—welding part; 31—bending part.

DETAILED DESCRIPTION

The solution of the present disclosure will be described below in conjunction with the accompanying drawings and the embodiment.

In the description of the present disclosure, it is to be noted that the orientational or positional relationships indicated by terms "above", "below", "left", "right", "vertical", "horizontal", "inside", "outside" and the like are based on the orientational or positional relationships illustrated in the drawing or the orientational or positional relationship in which products of the present disclosure are usually placed during use. These orientational or positional relationships are for the mere purpose of facilitating and simplifying the description of the present disclosure and do not indicate or imply that the apparatus or element referred to has a specific orientation and is constructed and operated in a specific orientation. In addition, terms such as "first" and "second" are used merely for the purpose of description, or are used for distinguish different structures or components, and are not to be construed as indicating or implying relative importance.

In the description of the present disclosure, it should be noted that unless otherwise expressly specified and limited, the term "mounting", "connected to each other" or "connected" is to be construed in a broad sense, for example, as securely connected or detachably connected; mechanically connected or electrically connected; directly connected to each other or indirectly connected to each other via an intermediary; or internally connected between two elements. For those of ordinary skill in the art, meanings of the preceding terms in the present disclosure may be construed based on situations.

The solutions of the present disclosure will be further described below through specific embodiments in conjunction with the drawings.

Figure 2:
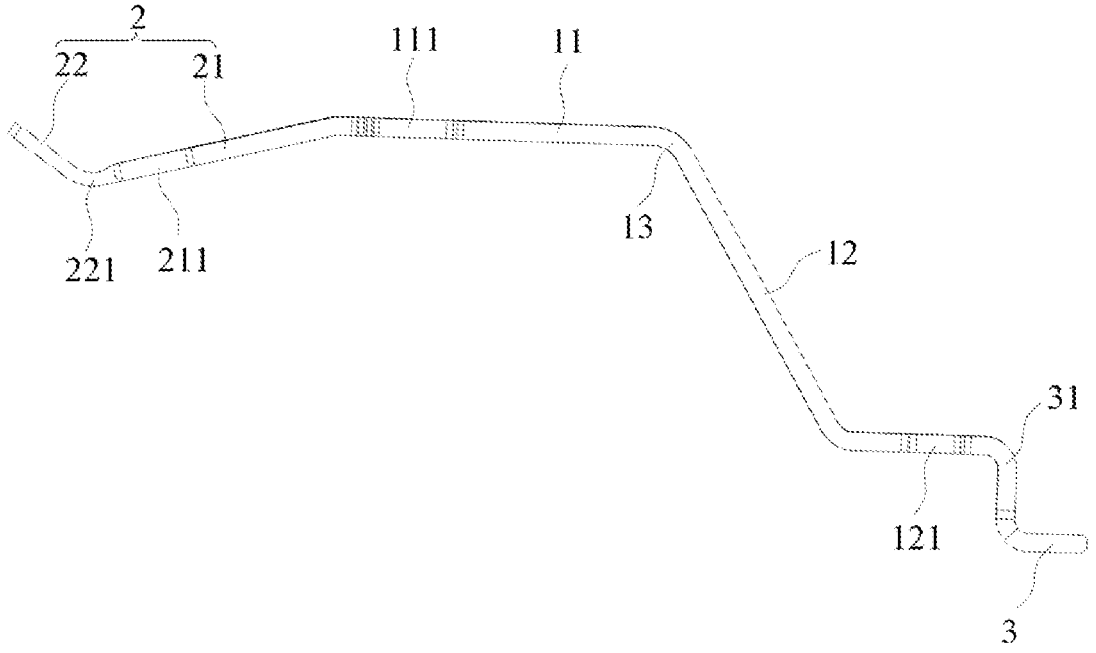
FIG. 2 is a side view of a terminal body provided by an embodiment of the present disclosure.

Referring to FIGS. 1 and 2, this embodiment provides a connector terminal. The connector terminal includes an insulation body 100 and multiple terminal bodies arranged on the insulation body 100, Each of the multiple terminal bodies includes a base part 1, an elastic arm 2 and a welding part 3. The base part 1 includes a first base part 11 and a second base part 12 which are arranged at an included angle, the first base part 11 and the second base part 12 form a bending structure, a first end of the first base part 11 is embedded in the insulation body 100, a second end of the first base part 11 is connected to a first end of the second base part 12, and a second end of the second base part 12 is embedded in the insulation body 100. The elastic arm 2 is connected to a first end of the first base part 11 and extends out of a first end of the insulation body 100. The welding part 3 is connected to the second end of the second base part 12 and extends out of a second end of the insulation body 100.

In the connector terminal in this disclosure, a main body fixing structure of the connector terminal is formed by embedding two ends of the base part 1 into the insulation body 100, the elastic arm 2 arranged at the first end of the first base part 11 extends out of the first end of the insulation body for operation, and the welding part 3 arranged at the second end of the second base part 12 extends out of the second end of the insulation body 100 for being connected to the circuit board. The base part 1, the elastic arm 2 and the welding part 3 of the multiple terminal bodies are pressure molded so as to be cut and bent for one time, and then the multiple terminal bodies and the insulation body 100 are injection molded integrally by the injection molding, so that a secondary bending is avoided effectively, and the processing technology is simplified, thereby facilitating improving the processing accuracy and reducing the manufacturing costs.

Referring to FIG. 2, the elastic arm 2 includes a support part 21 and a contact part 22, a first end of the support part 21 is connected to the first end of the first base part 11, the contact part 22 is arranged at a second end of the support part 21. A bending direction of the contact part 22 with respect to the support part 21 is opposite to a bending direction of the second base part 12 with respect to the first base part 11 so that the contact part 22 protrudes upward with respect to the support part 21, so that the contact part 22 is in stable electrical contact with a chip module of the connector.

Referring to FIG. 2, one end of the contact part 22 facing the support part 21 is provided with a first arc-shaped section 221, the contact part 22 is connected to the extension section 211 through the first arc-shaped section 221, and an inner side of the first arc-shaped section 221 is arranged facing away from an inner side of the bending structure. The support part 21 and the contact part 22 are connected through the first arc-shaped section 221, thereby avoiding the stress concentration at the connection between the support part 21 and the contact part 2, improving the overall strength of the elastic arm 2, and ensuring the electrical contact between the contact part 22 and the chip module.

Referring to FIG. 2, a second arc-shaped section 13 is provided between the first base part 11 and the second base part 12, and an inner side of the second arc-shaped section 13 is arranged facing an inner side of the bending structure. The first base part 11 and the second base part 12 are connected through the second arc-shaped section 13, thereby avoiding the occurrence of the stress concentration when the base part 1 is subjected to an external force, and improving the strength of the base part 1.

Referring to FIG. 2, the first end of the first base part 11 is provided with a second fixing part 111, the first base part 11 is connected to the support part 21 through the second fixing part 111, the second fixing part 111 is arranged in parallel with the first base part 11, and the second fixing part 111 is partially embedded in the insulation body 100 and partially extends out of the insulation body 100. The second fixing part 111 provides fixed support for the elastic arm 2, so that the elastic arm 2 protruding out of the insulation body 100 can withstand the pressure of the chip module until a stable electrical connection is reached.

Referring to FIG. 2, the second end of the second base part 12 is provided with a first fixing part 121, the second base part 12 is connected to the welding part 3 through the first fixing part 121, a bending direction of the first fixing part 121 with respect to the second base part 12 is opposite to a bending direction of the first base part 11 with respect to the second base part 12, the first fixing part 121 is partially embedded in the insulation body 100 and partially extends out of the insulation body 100. The first fixing part 121 not only ensures the connection strength between the welding part 3 and the insulation body 100, but also provides a suitable position for the arrangement of the welding part 3, so that the welding part 3 can better cooperate with the insulation body 100 to realize the stable electrical connection with a circuit board to communicate.

Referring to FIG. 2, the welding part 3 is connected to the first fixing part 121 through a connection part 31, a bending direction of the connection part 31 with respect to the first fixing part 121 is opposite to the bending direction of the second base part 12 with respect to the first fixing part 121, and the welding part 3 extends in a direction facing away from an inner side of the bending structure. The first fixing part 121 cooperates with the connection part 31, so that an extended position of the welding part 3 is convenient for welding the circuit board, thereby ensuring the stable electrical connection between the connector terminal and the circuit board to communicate.

Optionally, the second end of the support part 21 facing the contact part 22 is provided with an extension section 211, the support part 21 is connected to the contact part 22 through the extension section 211, and a cross-sectional area of the extension section 211 gradually decreases from the support part 21 to the contact part 22 to provide a stable support force for the contact part 22. The support part 21 has a first side 212 and a second side 213 arranged in parallel with each other, and the extension section 211 has a third side 2111 and a fourth side 2112 arranged opposite to each other.

In this embodiment, referring to FIG. 1, multiple terminal bodies include a first terminal body 201, a second terminal body 202, and a third terminal body 203, the first terminal body 201, the second terminal body 202, and the third terminal body 203 are sequentially arranged at intervals and in parallel with each other.

Figure 3:
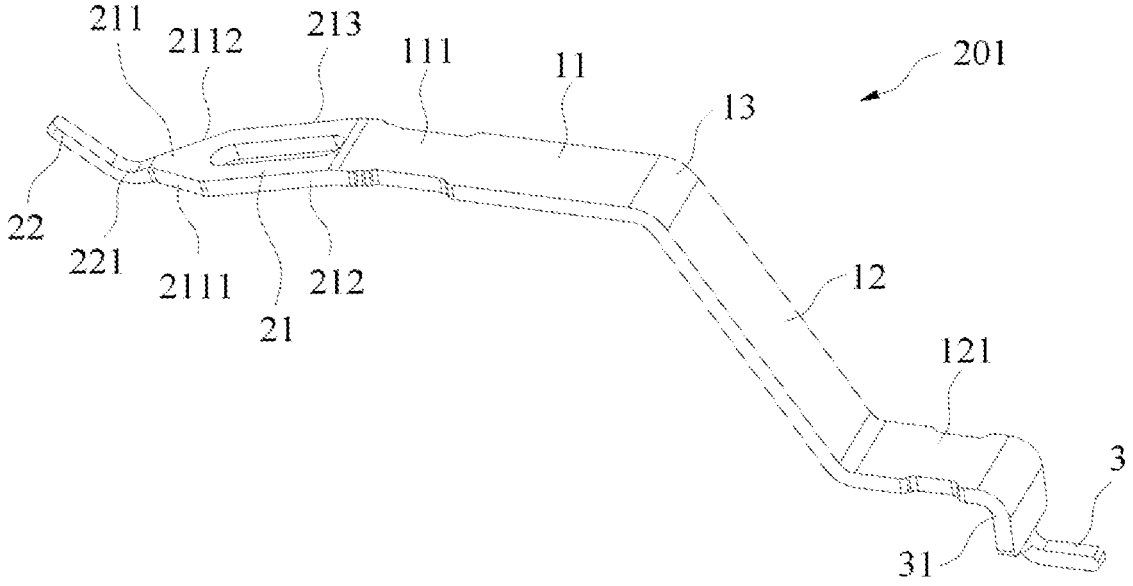
FIG. 3 is a structural diagram of a first terminal body provided by an embodiment of the present disclosure.

In one embodiment, referring to FIG. 3, from the support part 21 to the contact part 22, the third side 2111 and the fourth side 2112 of the extension section 211 on the first terminal body 201 are arranged obliquely towards an axial direction of the extension section 211 respectively, so that the cross-sectional area of the extension section 211 is gradually decreased to provide a stable support force for the contact part 22.

Figure 4:
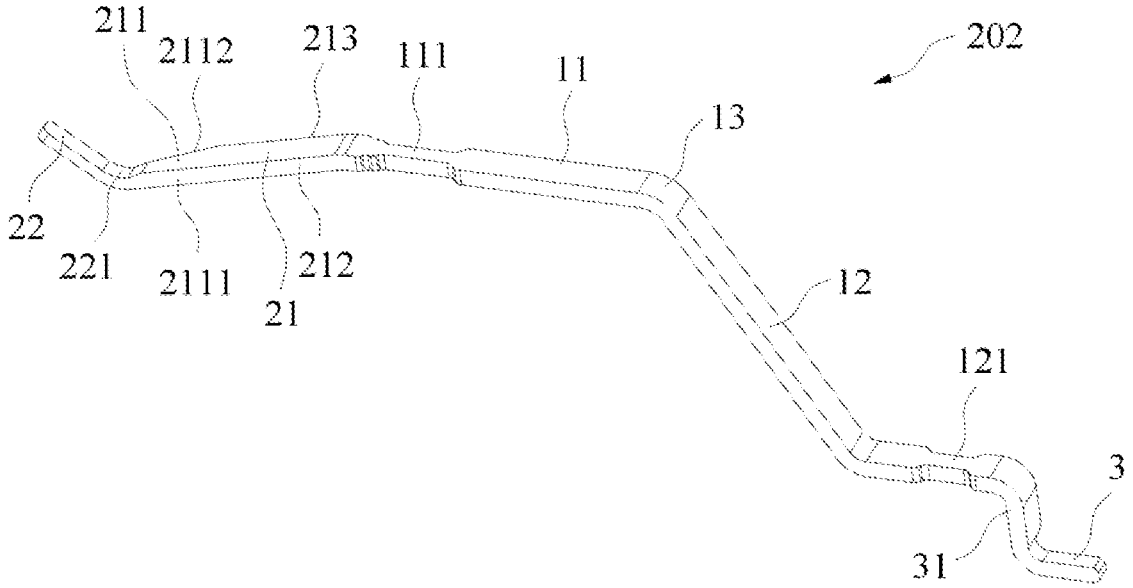
FIG. 4 is a structural diagram of a second terminal body provided by an embodiment of the present disclosure.

In one embodiment, referring to FIG. 4, the third side 2111 of the extension section 211 on the second terminal body 202 is arranged to extend along the first side 212 of the support part 21. From the support part 21 to the contact part 22, the fourth side 2112 of the extension section 211 on the second terminal body 202 is arranged obliquely towards the third side 2111 so that the cross-sectional area of the extension section 211 is gradually decreased to provide the stable support force for the contact part 22.

Figure 5:
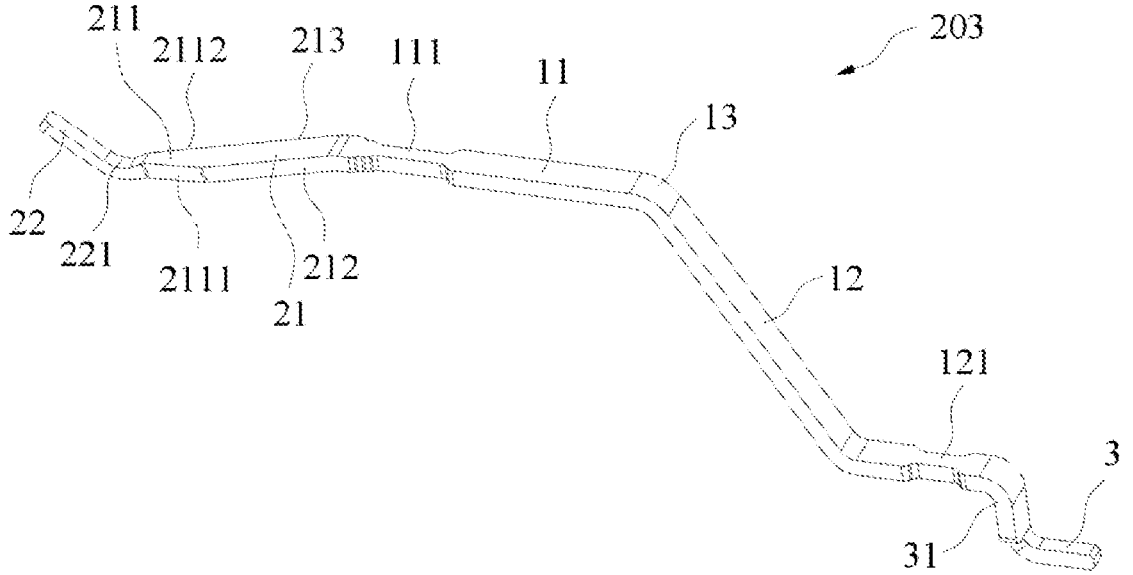
FIG. 5 is a structural diagram of a third terminal body provided by an embodiment of the present disclosure.

In one embodiment, referring to FIG. 5, the fourth side 2112 of the extension section 211 on the third terminal body 203 is arranged to extend along the second side 213 of the support part 21. From the support part 21 to the contact part 22, the third side 2111 of the extension section 211 on the third terminal body 203 is arranged obliquely towards the fourth side 2112 so that the cross-sectional area of the extension section 211 is gradually decreased to provide the stable support force for the contact part 22.

Optionally, referring to FIG. 3, the support part 21 on the first terminal body 201 is provided with a through hole to increase a surface contact area of the support portion 21, which is favorable to the stable electrical connection between the elastic arm 2 and the chip module.

Referring to FIG. 1, multiple first terminal bodies 201, multiple second terminal bodies 202 and multiple third terminal bodies 203 are provided separately in this embodiment. In one embodiment, the multiple first terminal bodies 201 are arranged at intervals and in parallel with each other on the insulation body 100, one second terminal body 202 and one third terminal body 203 are arranged between two adjacent ones of the multiple first terminal bodies 201, and the fourth side 2112 of the second terminal body 202 is arranged opposite to the third side 2111 of the third terminal body 203.

This embodiment also provides a manufacturing method of a connector terminal. The connector terminal includes an insulation body 100 and multiple terminal bodies embedded in the insulation body 100. The manufacturing method of the connector terminal includes a cutting and bending step, and an injection molding step.

In the cutting and bending step: the multiple terminal bodies are pressure molded so as to be cut and bent for one time. That is, the base part 1, the elastic arm 2 and the welding part 3 on the terminal body are pressed and molded for one time by a cutting and bending equipment, and the terminal body after being pressure molded so as to be cut and bent is shown in FIG. 2.

In the injection molding step, the insulation body 100 is injection molded on the multiple terminal bodies. After the injection molding, the connector terminal is manufactured. With this configuration, a secondary bending is not required, thereby ensuring the accuracy of the connector terminal.

Before the injection molding step, multiple terminal bodies are arranged in parallel with each other, the base part 1 is arranged in the injection molding area, and the elastic arm 2 and the welding part 3 are arranged outside the injection molding area. That is, it is ensured that after the injection molding, all elastic arms 2 of the multiple terminal bodies on the connector terminal extend out of the first end of the insulation body 100 for being electrically connected to the chip module, and all welding parts 3 extend out of the second end of the insulation body 100 for being connected to the circuit board.

In the connector terminal and the manufacturing method thereof in the present disclosure, a main body fixing structure of the connector terminal is formed by embedding two ends of the base part into the insulation body, the elastic arm arranged at the first end of the first base part extends out of the first end of the insulation body for operation, and the welding part arranged at the second end of the second base part extends out of the second end of the insulation body for being connected to the circuit board. The base part, the elastic arm and the welding part of the multiple terminal bodies are cut, bent, pressed and molded for one time, and then the multiple terminal bodies and the insulation body are injection molded integrally by the injection molding, so that a secondary bending is avoided effectively, and the processing technology is simplified, thereby facilitating improving the processing accuracy and reducing the manufacturing costs.

What is claimed is:

1. A connector terminal, comprising: an insulation body and a plurality of terminal bodies arranged on the insulation body, wherein each of the plurality of terminal bodies comprises:

a base part, wherein the base part comprises a first base part and a second base part wherein the first base part and the second base part form an included angle between the first base part and the second base part, the first base part and the second base part form a bending structure, a first end of the first base part is embedded in the insulation body, a second end of the first base part is connected to a first end of the second base part, and a second end of the second base part is embedded in the insulation body;

an elastic arm, wherein the elastic arm is connected to the first end of the first base part and extends out of a first end of the insulation body; and a welding part, wherein the welding part is connected to the second end of the second base part and extends out of a second end of the insulation body, wherein the second end of the second base part is provided with a first fixing part, the second base part is connected to the welding part through the first fixing part, a bending direction of the first fixing part with respect to the second base part is opposite to a bending direction of the first base part with respect to the second base part, the first fixing part is partially embedded in the insulation body and partially extends out of the insulation body.

2. The connector terminal of claim 1, wherein the elastic arm comprises a support part and a contact part, a first end of the support part is connected to the first end of the first base part, the contact part is arranged at a second end of the support part, and a bending direction of the contact part with respect to the support part is opposite to a bending direction of the second base part with respect to the first base part.

3. The connector terminal of claim 2, wherein the second end of the support part facing the contact part is provided with an extension section, the support part is connected to the contact part through the extension section, and a cross-sectional area of the extension section gradually decreases from the support part to the contact part.

4. The connector terminal of claim 3, wherein one end of the contact part facing the support part is provided with an arc-shaped section, the contact part is connected to the extension section through the arc-shaped section, and an inner side of the first arc-shaped section is arranged facing away from an inner side of the bending structure.

5. The connector terminal of claim 1, wherein an arc-shaped section is provided between the first base part and the second base part, and an inner side of the arc-shaped section is arranged facing an inner side of the bending structure.

6. The connector terminal of claim 1, wherein the first end of the first base part is provided with a second fixing part, the first base part is connected to the elastic arm through the second fixing part, the second fixing part is arranged in parallel with the first base part, and the second fixing part is partially embedded in the insulation body and partially extends out of the insulation body.

7. The connector terminal of claim 1, wherein the welding part is connected to the first fixing part through a connection part, a bending direction of the connection part with respect to the first fixing part is opposite to the bending direction of the second base part with respect to the first fixing part, and the welding part extends in a direction facing away from an inner side of the bending structure.

8. A manufacturing method of a connector terminal, wherein the connector terminal comprises: an insulation body and a plurality of terminal bodies arranged on the insulation body, wherein each of the plurality of terminal bodies comprises:

a base part, wherein the base part comprises a first base part and a second base part, wherein the first base part and the second base part form an included angle between the first base part and the second base part, the first base part and the second base part form a bending structure, a first end of the first base part is embedded in the insulation body, a second end of the first base part is connected to a first end of the second base part, and a second end of the second base part is embedded in the insulation body;

an elastic arm, wherein the elastic arm is connected to the first end of the first base part and extends out of a first end of the insulation body; and a welding part, wherein the welding part is connected to the second end of the second base part and extends out of a second end of the insulation body, wherein the second end of the second base part is provided with a first fixing part, the second base part is connected to the welding part through the first fixing part, a bending direction of the first fixing part with respect to the second base part is opposite to a bending direction of the first base part with respect to the second base part, the first fixing part is partially embedded in the insulation body and partially extends out of the insulation body;

the method comprises:

a cutting and bending step: in which the plurality of terminal bodies are pressure molded so as to be cut and bent for one time; and an injection molding step: in which the insulation body is injection molded on the plurality of terminal bodies.

9. The manufacturing method of the connector terminal of claim 8, wherein before the injection molding step, the manufacturing method of the connector terminal further comprises: a step of arranging the plurality of terminal bodies in parallel with each other.

10. The manufacturing method of the connector terminal of claim 8, wherein the elastic arm comprises a support part and a contact part, a first end of the support part is connected to the first end of the first base part, the contact part is arranged at a second end of the support part, and a bending direction of the contact part with respect to the support part is opposite to a bending direction of the second base part with respect to the first base part.

11. The manufacturing method of the connector terminal of claim 10, wherein the second end of the support part facing the contact part is provided with an extension section, the support part is connected to the contact part through the extension section, and a cross-sectional area of the extension section gradually decreases from the support part to the contact part.

12. The manufacturing method of the connector terminal of claim 11, wherein one end of the contact part facing the support part is provided with an arc-shaped section, the contact part is connected to the extension section through the arc-shaped section, and an inner side of the arc-shaped section is arranged facing away from an inner side of the bending structure.

13. The manufacturing method of the connector terminal of claim 8, wherein an arc-shaped section is provided between the first base part and the second base part, and an inner side of the arc-shaped section is arranged facing an inner side of the bending structure.

14. The manufacturing method of the connector terminal of claim 8, wherein the first end of the first base part is provided with a second fixing part, the first base part is connected to the elastic arm through the second fixing part, the second fixing part is arranged in parallel with the first base part, and the second fixing part is partially embedded in the insulation body and partially extends out of the insulation body.

15. The manufacturing method of the connector terminal of claim 8, wherein the welding part is connected to the first fixing part through a connection part, a bending direction of the connection part with respect to the first fixing part is opposite to the bending direction of the second base part with respect to the first fixing part, and the welding part extends in a direction facing away from an inner side of the bending structure.

* * * * *